United States Patent [19]

Camilleri

[11] 4,022,468

[45] May 10, 1977

[54] TIRE WHEEL FOR BOWLING BALL RETURN

[76] Inventor: Thomas M. Camilleri, 277 Avenue W, Brooklyn, N.Y. 11226

[22] Filed: Dec. 15, 1975

[21] Appl. No.: 640,430

[52] U.S. Cl. ..... 273/49

[51] Int. Cl.[2] ..... A63D 5/02

[58] Field of Search ..... 273/49, 43 E; 124/1, 124/78; 198/127 R, 127 E

[56] References Cited

UNITED STATES PATENTS

| | | | |
|---|---|---|---|
| 2,796,261 | 6/1957 | Turner | 273/49 |
| 3,127,172 | 3/1964 | Troiano et al. | 273/49 |
| 3,425,691 | 2/1969 | Lenhart | 273/49 |
| 3,459,168 | 8/1969 | Bruce | 124/78 |

FOREIGN PATENTS OR APPLICATIONS

| | | | |
|---|---|---|---|
| 696,013 | 10/1964 | Canada | 273/49 |

*Primary Examiner*—Anton O. Oechsle
*Attorney, Agent, or Firm*—Donald J. Perrella

[57] ABSTRACT

A tire wheel for a bowling ball return system is provided with a high friction surface. The high friction surface is achieved by way of a circumferential strip of a flexible elastomeric material which is adhered to the surface of the tire wheel. One end of the strip is provided with a bevel which faces in the direction of wheel rotation. The wheel is disposed along an upwardly inclined portion of a bowling ball return track.

3 Claims, 4 Drawing Figures

TIRE WHEEL FOR BOWLING BALL RETURN

BACKGROUND OF THE INVENTION

The present invention relates to the ball return system for one type of automatic pinsetting machine and, more particularly, to the tire wheel which forms part of the system for returning the ball to the bowler.

In one type of ball return system, the ball is returned to the bowler via a covered conduit. Just before the end of the conduit nearest the bowler the ball goes up a small incline which arrests the momentum of the ball. At the top of the incline the now very slowly moving ball, encounters a rotating tire wheel which delivers the ball to the rack where the bowler picks up the ball. When the ball has picked up some of conditioning oil applied regularly to the lane as a maintenance operation, the ball may slip against the tire wheel and fall back down the incline instead of being gripped by the tire wheel and delivered to the pick-up rack. When the ball falls back down the incline, it comes to rest somewhere within the covered return conduit. All or part of the conduit must then be removed until the ball is located and removed manually. This situation, known as an "underlane," causes a serious delay and is a source of considerable annoyance to the bowlers as well as a time-consuming, money-losing inconvenience to the management.

OBJECTS OF THE INVENTION

It is an object of the present invention to provide an improved tire wheel. A further object is to provide a tire wheel which is effective for bowling balls which become coated with oil as well as for uncoated bowling balls. Another object is to provide a method for preventing malfunction of the tire wheel. These and other objects of the present invention will become apparent from the following description.

SUMMARY OF THE INVENTION

An improved tire wheel for a bowling ball return system is obtained by applying a high coefficient of friction surface to the surface of the tire wheel which contacts the bowling ball.

DETAILED DESCRIPTION

Figure 1:
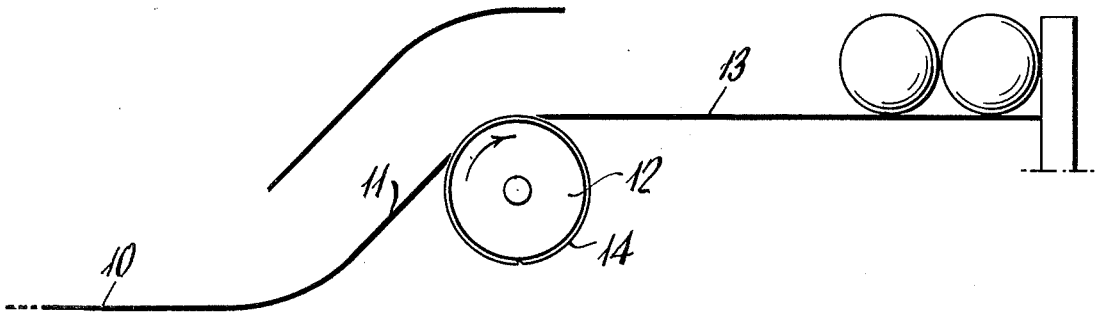
FIG. 1 is a schematic side elevation of part of a ball return system.
Figure 2:
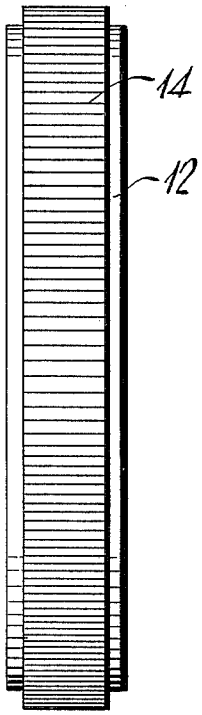
FIG. 2 is a front elevation view of a tire wheel.
Figure 3:
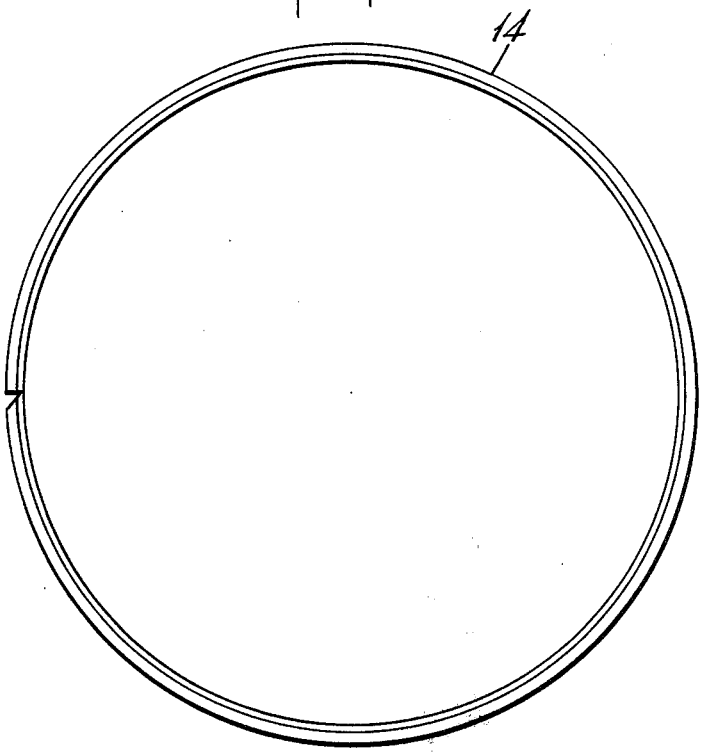
FIG. 3 is an enlargement of the tire wheel of FIG. 1.
Figure 4:
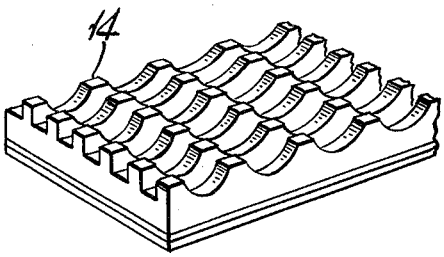
FIG. 4 is an enlarged perspective view of a part of FIG. 2.

As shown in FIG. 1 of the drawings the bowling ball is returned to the bowler along conduit 10 which is provided with a cover (not shown as unnecessary to the invention). As it nears the bowler, conduit 10 is terminated in a short but steep incline 11 which substantially absorbs the momentum of the bowling ball. At the top of the incline the ball encounters a tire wheel 12 which is driven by a motor (not shown) so as to rotate in the direction shown by the arrow. The tire wheel then delivers the ball to the pick up rack 13. As indicated previously the ball, particularly when coated with oil, may fail to be gripped by the tire wheel and may fall back down the incline. When this happens the ball comes to rest somewhere along conduit 10 although its precise location cannot be seen because of the covering over the conduit. In such a case, the covering must be removed one piece at a time until the ball is located and manually removed. According to the present invention this problem is eliminated by providing the tire wheel with a high coefficient of friction surface, preferably a rough, irregular high coefficient of friction surface. As shown in FIGS. 1 and 2, the high coefficient of friction surface is a strip wrapped around the surface of the tire wheel that contacts the bowling ball and is adhered to the wheel by a suitable adhesive. FIG. 4 shows the high coefficient of friction surface in detail.

The high coefficient surface may be formed of various elastomeric materials such as, e.g., gum rubber, chlorinated butyl rubber, polyurethane and the like.

Preferably the high coefficient of friction surface is formed of belting material having a carcass of one or more plies of material and a top surface formed of a rough, irregular elastomeric material of the type mentioned above adhered to the carcass in known manner e.g., by vulcanizing. Preferably one end of the high coefficient of friction strip is bevelled and the strip is applied so that the bevel faces the direction of rotation of the tire wheel as shown in FIG. 1.

What is claimed is:

1. In a bowling ball return mechanism including a tire wheel in combination with a curved inclined conduit the improvement wherein the tire wheel has adhered to its ball-contacting surface a circumferential strip of a flexible elastomeric material having a high coefficient of friction, the ends of the strip being in abutting relationship, one end of the strip being provided with a bevel facing the direction of rotation.

2. A tire wheel according to claim 1 wherein the strip is provided as the outer surface layer of a multi-ply belt.

3. A tire wheel according to claim 2 wherein the strip which contacts the bowling ball is uneven.

* * * * *